US006284097B1

(12) United States Patent
Wulz et al.

(10) Patent No.: US 6,284,097 B1
(45) Date of Patent: Sep. 4, 2001

(54) METHOD AND APPARATUS TO PRODUCE PAPER WEBS COATED ON BOTH SIDES

(75) Inventors: Hans-Jürgen Wulz; Rüdiger Kurtz, both of Heidenheim; Gerhard Kotitschke, Steinheim; Bernhard Kohl, Heidenheim; Peter Petermann, Dinslaken; Erhard Gruber, Mettmann, all of (DE)

(73) Assignee: Voith Sulzer Papiermaschinen GmbH, Heidenheim (DE)

( * ) Notice: Subject to any disclaimer, the term of this patent is extended or adjusted under 35 U.S.C. 154(b) by 0 days.

(21) Appl. No.: 09/018,975

(22) Filed: Feb. 5, 1998

(30) Foreign Application Priority Data

Feb. 10, 1997 (DE) ..... 197 04 858

(51) Int. Cl.[7] ..... D21F 11/00

(52) U.S. Cl. ..... 162/137; 162/184; 162/265; 427/265; 427/411; 427/412; 427/356; 427/382; 427/428

(58) Field of Search ..... 162/135, 136, 162/137, 265, 184; 427/411, 412, 382, 356, 428

(56) References Cited

U.S. PATENT DOCUMENTS

| | | | | |
|---|---|---|---|---|
| 1,918,095 | * | 7/1933 | Germanson et al. | 162/184 |
| 2,949,382 | * | 8/1960 | Dickerman et al. | 427/356 |
| 4,495,888 | | 1/1985 | Wöhrle et al. | 118/410 |
| 4,980,207 | * | 12/1990 | Sollinger | 427/356 |
| 5,340,611 | * | 8/1994 | Kustermann et al. | 427/411 |
| 5,609,920 | | 3/1997 | Riepenhausen | 427/428 |

FOREIGN PATENT DOCUMENTS

| | | | |
|---|---|---|---|
| DE 295 0 637 A1 | 6/1981 | (DE) | F16B/21/18 |
| DE 38 40 610 A1 | 6/1990 | (DE) | B05C/1/08 |
| DE 4 414 949 A1 | 11/1995 | (DE) | B05C/1/08 |
| DE195 14 772 A1 | 10/1996 | (DE) | B05B/1/04 |
| DE195 15 7514 C1 | 11/1996 | (DE) | B05C/11/02 |

OTHER PUBLICATIONS

"Inhalts–Verzeichnis 1974" by L.G. Scheuring, *Wochenblatt für Papierfabrikation*, No. 11/12, 1974, pp. 393–400.

"Produktionserfahrungen und Versuchsergebnisse beim Einsatz der FILMPRESS als Streichaggregat" by R. Knop und Y. Sommer, *Wochenblatt für Papierfabrikation*, No. 10, 1955, pp. 436–443.

* cited by examiner

*Primary Examiner*—Peter Chin
(74) *Attorney, Agent, or Firm*—Taylor & Aust, P.C.

(57) ABSTRACT

A method of producing paper webs coated on both sides includes the following steps: a) indirectly applying a liquid onto the paper web by passing the web through at least one nip formed by a roll and a counterelement, whereafter the web is dried; b) next, directly applying coating mixture at surplus only on one side of the web, whereafter the surplus coating mixture is removed again by use of a doctor element, the web being dried again thereafter; and c) lastly, directly applying coating mixture at surplus only on the other web side, whereafter the surplus coating mixture is removed by use of a doctor, whereafter the web is dried again. In the indirect application of liquid in the nip, or in the nips, either coating mixture to produce so-called MWC papers or a sizing suspension to produce so-called LWC papers is selectively applied.

9 Claims, 2 Drawing Sheets

METHOD AND APPARATUS TO PRODUCE PAPER WEBS COATED ON BOTH SIDES

BACKGROUND OF THE INVENTION

1. Field of the Invention

The present invention relates to a method of producing paper webs coated on both sides and to an apparatus for the application of such method.

2. Description of the Related Art

More exactly, the present invention concerns a so-called multiple coating method in which a liquid medium is applied twice, successively on each paper side. Such multiple coating method is known from the magazine "Wochenblatt für Papierfabrikation" No. 11/12, 1974, pages 339 through 400; refer specifically to FIG. 4 on page 396. Illustrated there are four coaters of essentially the same structure. In each of the coaters, the paper web runs over a backing roll, with liquid medium being applied directly onto the paper web. Known from FIG. 1 of the same publication, however, is also the following: A precoat can first be applied indirectly onto each paper side, followed by a top coating applied by a direct method. Refer to "Wochenblatt für Papierfabrikation" No. 10, 1955, pages 436 through 443, notably FIG. 15.

SUMMARY OF THE INVENTION

Underlying the present invention, based on this prior art, is the improvement of the known multiple coating method and the apparatus provided for it, to the effect that several differently coated paper grades can be produced without appreciable modification of the machine. The present invention provides the ability to selectively produce so-called MWC (medium-weight catalog) paper or so-called LWC (lightweight catalog) paper. Understood as MWC and LWC papers are medium-weight and lightweight coated papers, respectively.

The present invention uses one or two initially provided applicators, with which liquid medium is applied indirectly onto the paper web, to apply, in the production of MWC paper, a socalled contour coating of pigmented coating color simultaneously or successively onto both paper sides. Alternatively, in the production of LWC paper, only one, preferably very thin, sizing suspension layer is applied simultaneously or successively onto both paper sides.

Hence, in the production of MWC papers, each web side is coated twice overall with coating mixture. In contrast, in the production of LWC papers, the indirectly applied sizing suspension forms on each web side a barrier layer between the raw paper web and the directly applied coating mixture.

Advantages of the present invention include, in the production of MWC paper, a considerably improved opacity as compared to the prior art, achieved with the aid of the applicator(s). In the production of LWC papers, the first two coaters, in contrast, make possible the use of a raw paper that is thinner than before. Also, a raw paper having a considerably lower coating weight, with the application of the sizing barrier layer, is able to have a top coating applied. The reason for this is that there is little or no penetration of the coating mixture into the inside of the raw paper. Therefore, a surface of high uniformity (better cover) is achieved, despite the low coating weight.

The metering device of the applicator(s) working indirectly may feature as a metering element a blade, a smooth roll doctor or a grooved roll doctor. The applicator of the coaters working directly may be configured as a roll applicator, a pressure chamber applicator (SDTA—short dwell time applicator), or as an open-jet applicator. The dryer units feature top-felted single-felt cylinder groups, since this configuration most easily allows a quick removal of broken parts, which is important for on-line operation.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
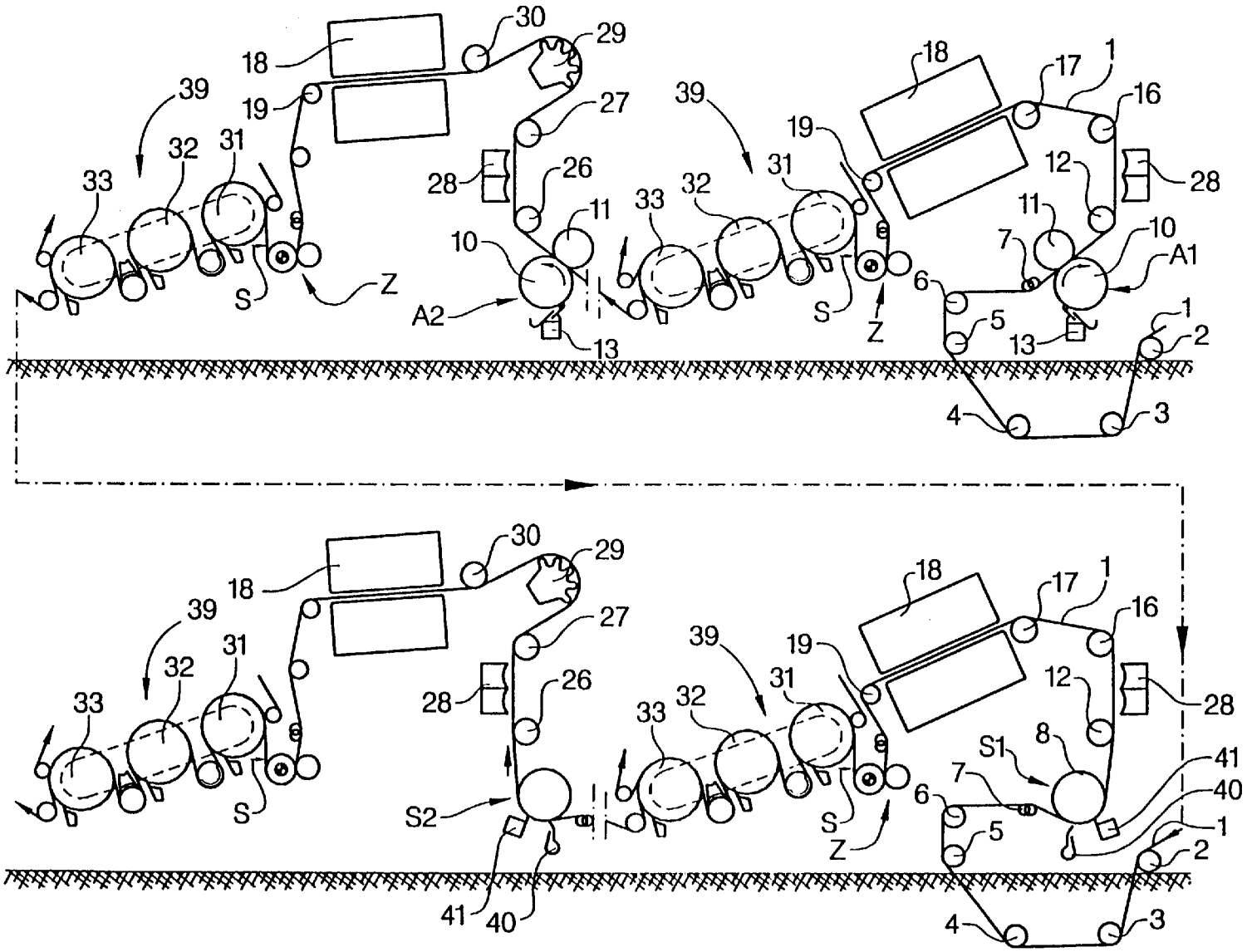
FIG. 1 is a schematic view of one embodiment of an apparatus of the present invention.

In FIG. 1, the following units are provided, among others: A first applicator unit A1 for indirect operation, a second applicator A2 working indirectly, a first coater S1 working directly, and a second coater S2 for direct application. Associated with each of the coaters and applicators are following infrared dryers 28 and hot-air dryers 18. Contact dryers 39 are configured as top-felted single-felt cylinder groups, allowing easy downward removal of any accruing scrap paper.

Coaters S1 and S2 each have an open-jet applicator 40 and a blade metering device 41. A possibly preceding smoothing unit and the always following smoothing and winding systems are not illustrated.

Coming from a not-illustrated paper machine, a paper web 1 runs over web-carrying rolls 2 through 7 into first applicator unit A1. The latter includes an applicator roll 10, backing roll 11 and an applicator 13. Web 1 proceeds obliquely upwardly through applicator unit A1 to a further web-carrying roll 12 which reverses web 1 upward in a substantially vertical direction. Web 1 passes an infrared dryer 28 and then continues through a hot-air dryer 18, carried by use of further web-carrying rolls 16, 17 and 19.

The latter web-carrying roll 19 is followed by a draw press Z, from which paper web 1, passing a fuzz cutter S, enters from below into a top-felted single-felt dryer group 39, including, e.g., two to five dryer cylinders 31 through 33. An endless felt, which can be fashioned as a porous drying wire, forces paper web 1 onto dryer cylinders 31–33 and passes it between the cylinders over reversing rolls, which can be suction rolls.

Following dryer group 39 is the second applicator unit A2, working indirectly, which is arranged in mirror-inverted fashion in relation to the first applicator unit A1, but is otherwise configured the same. From here, paper web 1 proceeds upward via web-carrying rolls 26 and 27, again passing an infrared dryer 28. Following roll 27 is a noncontact reversing system 29, a further web-carrying roll 30, a hot-air dryer 18, a further web-carrying roll 19 and a second contact dryer 39, which may be configured exactly the same as the one described above.

Following the second contact dryer 39 is first coater S1, working directly, to which paper web 1 is again carried via web-carrying rolls 2 through 7. In coater S1, paper web 1 wraps the bottom area of a roll 8. Coater S1 includes the previously mentioned open-jet applicator 40 and blade metering device 41. Following again now, in an arrangement the same as that after first applicator unit A1, are infrared dryer 28, hot-air dryer 18 and contact dryer 39, followed by the second direct-working coater S2, having a mirror-inverted arrangement relative to S1. The devices following coater S2 again exactly match those following second applicator unit A2.

Figure 2:
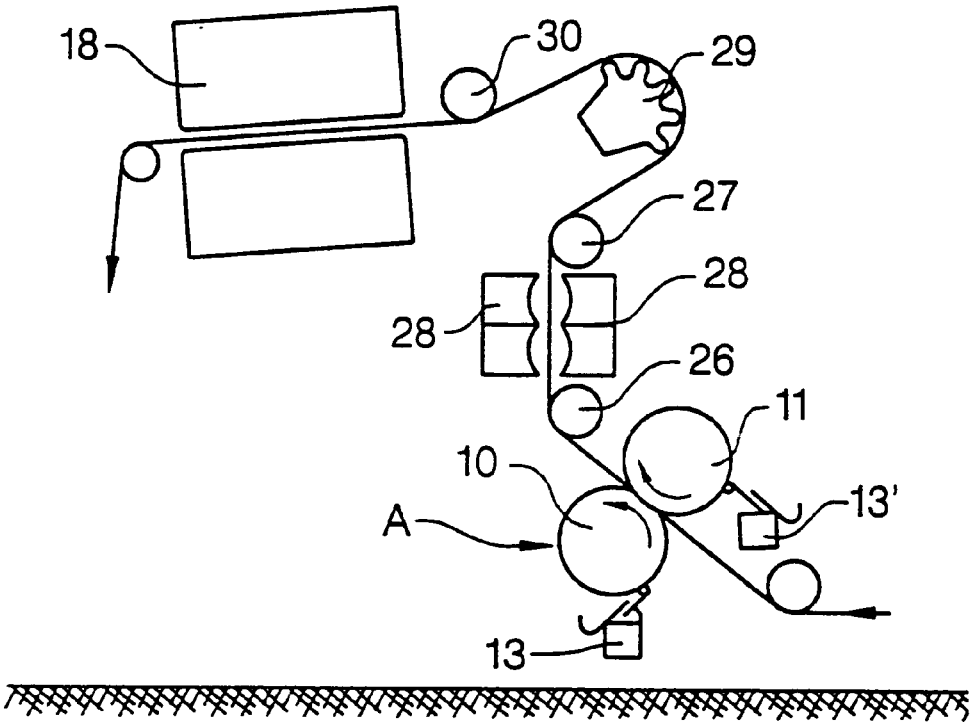
FIG. 2 is a schematic view of another embodiment of an apparatus of the present invention.

The two applicator units A1 and A2 illustrated in FIG. 1 may be replaced, according to FIG. 2, by a single applicator unit A whose rolls 10 and 11 are arranged exactly as in applicator unit A2 in FIG. 1. Again associated with bottom roll 10 is an applicator 13. Additionally, an applicator 13' is arranged on top roll 11. The special features of additional applicator 13' are known from German Patent Document No. DE 4 413 232 A1. Applicator A is followed by the same units as applicator A2 in FIG. 1.

As to the applicators 13, reference is made to German Patent Document No. DE 4 414 949 A1. With respect to contact dryer 39, reference is made to German Patent Document No. DE 295 0 637 U.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of producing one of a medium-weight-coated (MWC) paper and a lightweight-coated (LWC) paper, said method including coating a first side and a second side of a paper web, said method comprising the sequential steps of:

indirectly applying one of a contoured coating of pigmented coating color and a thin layer of sizing suspension onto the paper web by passing the paper web through at least one nip, each said nip being defined by an applicator roll and a counterelement, said applicator roll being in fluid communication with a coating applicator, said contoured coating being applied in the production of said MWC paper and said thin layer of sizing suspension being applied in the production of said LWC paper;

drying the paper web;

directly applying a coating mixture at a surplus onto the first side of the paper web;

removing surplus said coating mixture from the first side of the paper web with a doctor element;

drying the paper web;

directly applying a coating mixture at a surplus onto the second side of the paper web;

removing surplus said coating mixture from the second side of the paper web with a doctor element; and drying the paper web.

2. The method of claim 1, wherein said indirectly applying step includes simultaneously indirectly applying said one of a contoured coating and a thin layer of sizing suspension onto the first side and the second side of the paper web by passing the paper web through a single said nip.

3. The method of claim 1, wherein said indirectly applying step comprises the sequential sub-steps of passing the paper web through a first said nip to transfer said one of a contoured coating and a thin layer of sizing suspension onto the first side of the paper web; drying the paper web; and passing the paper web through a second said nip to transfer said one of a contoured coating and a thin layer of sizing suspension onto the second side of the paper web.

4. The method of claim 1, wherein the paper web has an operating speed of at least 800 m/min.

5. The method of claim 4, wherein said operating speed is at least 1000 m/min.

6. The method of claim 1, comprising the further step of passing the paper web through a heatable smoothing press after said last drying step.

7. The method of claim 6, wherein said step of passing the paper web through said heatable smoothing press occurs off-line.

8. The method of claim 6, wherein said step of passing the paper web through said heatable smoothing press occurs on-line within a paper machine.

9. The method of claim 1, wherein said indirectly applying step and said directly applying steps occur on-line within a paper machine.

* * * * *